US006053608A

United States Patent [19]

Ishii et al.

[11] Patent Number: 6,053,608

[45] Date of Patent: Apr. 25, 2000

[54] INK PELLET WITH STEP CONFIGURATION INCLUDING SLIDABLE BEARING SURFACES

[75] Inventors: Makoto Ishii; Hiroo Ogawa, both of Nagoya, Japan

[73] Assignee: Brother Kogyo Kabushiki Kaisha, Nagoya, Japan

[21] Appl. No.: 08/880,409

[22] Filed: Jun. 23, 1997

[30] Foreign Application Priority Data

| | | | |
|---|---|---|---|
| Jul. 24, 1996 | [JP] | Japan | 8-214304 |
| Jul. 25, 1996 | [JP] | Japan | 8-215406 |
| Jul. 26, 1996 | [JP] | Japan | 8-215251 |

[51] Int. Cl.[7] ..... B41J 2/175

[52] U.S. Cl. ..... 347/88

[58] Field of Search ..... 347/88, 86, 99, 347/100

[56] References Cited

U.S. PATENT DOCUMENTS

| | | | |
|---|---|---|---|
| D. 392,651 | 3/1998 | Ishii | 347/88 |
| 4,636,803 | 1/1987 | Mikalsen | 347/88 |
| 4,739,339 | 4/1988 | DeYoung et al. | 347/88 |
| 4,823,146 | 4/1989 | Cooke et al. | 347/88 |
| 4,870,430 | 9/1989 | Daggett et al. | 347/88 |
| 5,038,157 | 8/1991 | Howard | 347/88 |
| 5,510,821 | 4/1996 | Jones et al. | 347/88 |
| 5,630,510 | 5/1997 | Lamb, Jr. et al. | 347/88 |

FOREIGN PATENT DOCUMENTS

| | | | |
|---|---|---|---|
| 0340533 | 11/1989 | European Pat. Off. . | |
| 0519 700 A2 | 12/1992 | European Pat. Off. . | |
| 0703085 | 3/1996 | European Pat. Off. . | |
| 5-155012 | 12/1991 | Japan | 347/88 |

*Primary Examiner*—N. Le
*Assistant Examiner*—Thien Tran
*Attorney, Agent, or Firm*—Oliff & Berridge, PLC

[57] ABSTRACT

An ink pellet formed of solid hot melt ink is movably stored in an accommodating channel section of an ink supplying system relative to a tank section so as to provide a predetermined amount of hot melt ink to the tank section. The ink pellet has an upper portion having a lateral width greater than a channel width of the accommodating channel section, and a pellet main body forming step portions at sides of a lower surface of the upper portion, having a lateral width smaller than the channel width of the accommodating channel section, and having a height smaller than a channel height of the accommodating channel section.

18 Claims, 16 Drawing Sheets

INK PELLET WITH STEP CONFIGURATION INCLUDING SLIDABLE BEARING SURFACES

BACKGROUND OF THE INVENTION

1. Field of Invention

The invention relates to an ink pellet formed of hot melt ink in the solid state and used for an ink jet recording apparatus.

2. Description of Related Art

In an ink jet recording apparatus utilizing hot melt ink, the ink is heated and melted in an ink melting section provided with a heater. An ink droplet is then ejected from a nozzle onto, for example, a sheet of paper while main-scanning a recording head having a large number of nozzles, to thereby print characters or diagrams onto the sheet of paper.

Since the hot melt ink becomes solid at room temperature, it is normally processed into an ink pellet of a predetermined shape for storage. The hot melt ink is supplied to the ink melting section in the pellet form when the ink supply section becomes empty. If an operator directly touches the ink pellet at this time, stains or grease on the operator's hands are adhered to the ink pellet and deteriorate the quality of the hot melt ink.

As shown in FIG. 17, a conventional structure disclosed in U.S. Pat. No. 4,823,146 includes an ink holder 81 formed in the shape of a cup. The ink pellet 83 is formed so as to correspond to the internal shape of the ink holder 81 and the ink pellet 83 is stored in the ink holder 81. When ink runs out, the ink holder 81 is arranged such that an open end of the ink holder 81 is in contact with a supplying opening 82 of an ink melting section. The back side of the ink holder 81 is pressed by hand to be collapsed and deformed, with the result that the ink pellet 83 is supplied to the supplying opening 82 without being directly touched by the hands of the operator.

However, in the above-mentioned conventional structure in which a single ink pellet 83 is accommodated in the ink holder 81, only one ink pellet 83 is removed by the one operation of arranging the ink holder 81 above the supplying opening 82 and pressing to collapse and deform the ink holder 81. Therefore, in the case where the ink pellet 83 includes only a small amount of hot melt ink, the amount of ink supplied to the ink melting section by the one operation is small so that the ink frequently runs out. If the supply amount of ink is increased a predetermined amount in order to reduce the frequency of the ink empty condition, the operator must supply a greater number of the ink pellet 83 which increases the work load of the operator.

On the other hand, if the ink pellet 83 is formed to include a larger supply of hot melt ink so as to reduce the frequency of the above-mentioned ink empty condition and the work load of the operator, the supply amount is liable to be excessive in relation to an amount of ink normally consumed in use of a typical ink jet recording apparatus. Accordingly, the hot melt ink is heated for a long time in the ink melting section reducing the quality of the ink.

As shown in FIG. 18, U.S. Pat. No. 4,636,803 discloses a structure in which a plurality of ink pellets 71, each formed of a small amount of hot melt ink, are stored in a tubular housing 75. When an ink melting section 72 runs out of ink, the ink pellet 71 is moved to a discharge opening 75A by the rotation of a driving shaft 73 by a motor 74 to move the ink pellet 71 from the discharge opening 75A into the ink melting section 72. With this structure, storage and supply of the ink pellet 71 is provided without the need for operator intervention, thereby not increasing the burden to an operator when the number of ink pellets to be supplied is increased.

However, with the above-mentioned structure, the entire bottom surface of the ink pellet 71 contacts with an inner wall surface of the housing 75 so that, when the ink pellet 71 is moved, the friction force is large. The friction force increases in proportion to the stored number of ink pellets 71. Therefore, to smoothly move the ink pellet 71 requires that the ink supplying apparatus be provided with a mechanism such as a driving shaft 73 capable of providing a sufficiently large driving force in relation to the large friction force. This causes the ink supplying apparatus to be large and complex.

To solve the above-mentioned problem that hot melt ink is heated for a long time in the ink melting section, another structure as described below has been proposed. With this structure, an ink jet recording apparatus is provided with an ink supplying apparatus in which an ink pellet formed of a small amount of hot melt ink is stored in an accommodating channel section of an ink supplying system relative to an ink melting section. The ink pellet is then discharged from the accommodating channel section to the ink melting section upon the ink empty condition.

Accordingly, the storage and supply of the ink pellet can be performed without the intervention of the operator so that the burden to an operator is not increased even if the number of the ink pellets to be supplied is increased. However, when the ink pellet is fed along the accommodating channel section, if the width of the accommodating channel section and the size of the ink pellet do not correspond, the ink pellet may rotate as it is fed along the accommodating channel section changing its orientation. If this happens, the ink pellet may clog the accommodating channel section and be stuck therein. If the ink pellet is stuck, the operator has to unclog the accommodating channel section and free the ink pellet. This requires operator intervention where the aim of the ink supplying apparatus discussed above was to supply the ink pellet without the intervention of the operator.

SUMMARY OF THE INVENTION

In view of the problems discussed above, an object of the invention is to provide an ink pellet having small frictional resistance during movement of the ink pellet stored in an accommodating channel section of an ink supplying apparatus and supplied along the accommodating channel section to an ink melting section in order to reduce the work required of an operator.

Another object of the invention is to provide an ink pellet which does not clog the accommodating channel section due to a change in orientation as the ink pellet is moved along the accommodating channel section in order to reduce the burden on an operator.

Another object of the invention is to provide an ink holder capable of storing and supplying a necessary number of ink pellets to supply hot melt ink in a predetermined amount.

According to a preferred embodiment of the invention, an ink pellet assembly includes an ink pellet formed of solid hot melt ink and movably stored in an accommodating channel section of an ink supplying apparatus relative to an ink melting section and supplied to the ink melting section so that a predetermined amount of ink is melted. The ink pellet includes an upper contacting portion having a width slightly greater than a channel width of the accommodating channel section and a pellet main body having step portions at both sides of a lower surface of the upper contacting portion, a width smaller than the channel width of the accommodating channel section and a height smaller than a channel height of the accommodating channel section.

With this structure, the ink pellet is supported by contact of the upper surface of the accommodating channel section with the step portion formed by the upper contacting portion and the pellet main body. Accordingly, the pellet main body does not contact with the accommodating channel section and the contacting area is decreased compared to the case in which the pellet main body contacts with the accommodating channel section. Accordingly, the ink pellet has small frictional resistance and smoothly moves even when the urging force is small. Further, if the ink pellet is formed of a small amount of hot melt ink, the storage and supply of the ink pellet can be performed without the intervention of the operator. Thus, the burden on the operator is not increased even if the ink pellet needs to be replaced often.

The center of gravity of the ink pellet may exist on the pellet main body. Because the center of gravity is on the pellet main body rather than on the step portion, the chance of the pellet falling over upon movement of the ink pellet is reduced.

Further, the pellet main body may be inclined on both sides such that the width of the pellet main body becomes gradually smaller from its upper surface to its lower surface. With this structure, even when the ink pellet jerks from side to side when moved, both sides of the pellet main body do not contact with the side wall surfaces of the accommodating channel section, thereby not increasing frictional resistance at the time of the movement of the ink pellet.

Also, the ink pellet may be supported by an ink holder to be replenished to the accommodating channel section. The ink pellet may be supported by the ink holder by engagement of a supporting section of the ink holder with the step portions of the pellet main body. With this structure, the step portions of the pellet main body are utilized for supporting the ink pellet within ink holder and also for supporting the pellet within the accommodating channel section. Thus, the ink pellet can have a simple shape while facilitating the processing of the ink pellet as compared to the case where the ink pellet is supported by other structure of the ink pellet.

Further, the supporting section of the ink holder may be formed of a pair of claw members for supporting the ink pellet by engaging with at least two sides of the ink pellet. The accommodating channel section may have a pair of engagement releasing members corresponding to the pair of claw members for releasing the engagement by pushing open both of the claw members. Thus, the ink pellet can be supported and supplied to the accommodating channel section by a simple mechanism.

Furthermore, the supporting section of the ink holder may include at least one guide member that contacts with a side surface of the ink pellet to maintain the orientation of the ink pellet upon movement of the ink pellet into the accommodating channel section. The ink pellet can thus be moved to the accommodating channel section with a predetermined orientation maintained by a simple mechanism.

The ink pellet may further have a rectangular cross-section and a diagonal distance of the cross-section of the ink pellet at the portion which is stored in the accommodating channel section may be configured to be greater than a channel width of the accommodating channel section. Since the diagonal distance of the ink pellet is greater than the channel width of the accommodating channel section, the ink pellet does not greatly change its orientation during movement along the accommodating channel section and therefore does not clog the accommodating channel section due to the contact of the corner portion of the ink pellet with the side wall surface of the accommodating channel section, even when the ink pellet is rotated during movement in the accommodating channel section. Further, where the ink pellet is formed of a small amount of hot melt ink, the storage and supply of the ink pellet can be performed without intervention by the operator, thereby reducing the work required of the operator even if the ink pellet needs to be replaced often.

Further, the diagonal distance of the cross-section preferably may be greater than the channel width of the accommodating channel section by approximately 0.5 mm or more. This structure reduces the frequent contact of the side surfaces or corner portions of the ink pellet with the side wall surfaces of the accommodating channel section when the ink pellet is moved, even if the ink pellet is somewhat deformed. This prevents rotation of the ink pellet due to the breakdown or abrasion of the ink pellet and reduces the frictional force caused by the contact resulting in smoother movement.

A width of the ink pellet may be configured such that a side surface of the ink pellet is spaced apart from a side wall surface of the accommodating channel section by approximately 1 mm or more. This structure reduces the frequent contact of the side surfaces or corner portions of the ink pellet with the side wall surfaces of the accommodating channel section when the ink pellet is moved even if the ink pellet is somewhat deformed, thereby preventing rotation of the ink pellet due to the breakdown or abrasion of the ink pellet and reducing the frictional force caused by the contact resulting in smoother movement. Further, this structure allows a user to easily confirm whether the ink pellet is correctly positioned in the accommodating channel section.

The predetermined amount of ink may be an amount capable of printing one or more pages. Further, the predetermined amount of ink may be an amount which will not significantly deteriorate while in the ink melting section under normal conditions of use. This structure ensures that a printing operation with ink of good quality can be performed for one page or more.

BRIEF DESCRIPTION OF THE DRAWINGS

These and other aspects and advantages of the invention will become apparent from the following detailed description of a preferred embodiment when taken in conjunction with the accompanying drawings, in which.

DETAILED DESCRIPTION OF PREFERRED EMBODIMENTS

Figure 1:
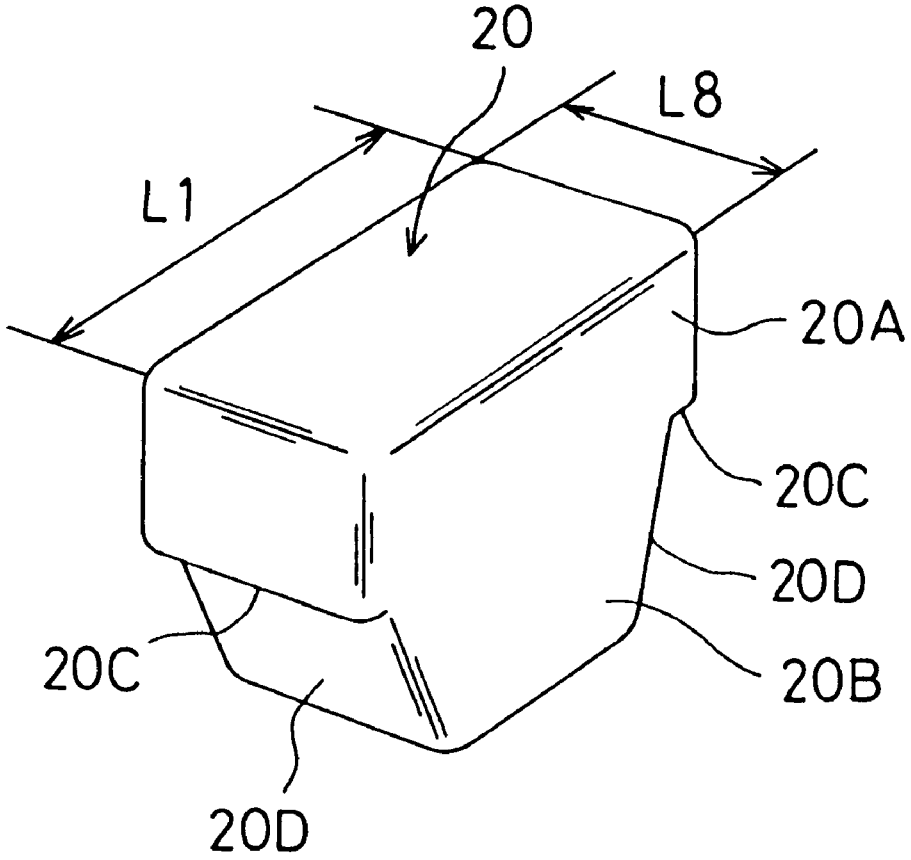
FIG. 1 is a perspective view of an ink pellet according to the invention.

While the invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

For a general understanding of the features of the invention, reference is made to the drawings. In the drawings, like reference numerals have been used throughout to designate identical elements.

A preferred embodiment of the invention will be explained with reference to FIG. 1 to FIG. 16.

Figure 2:
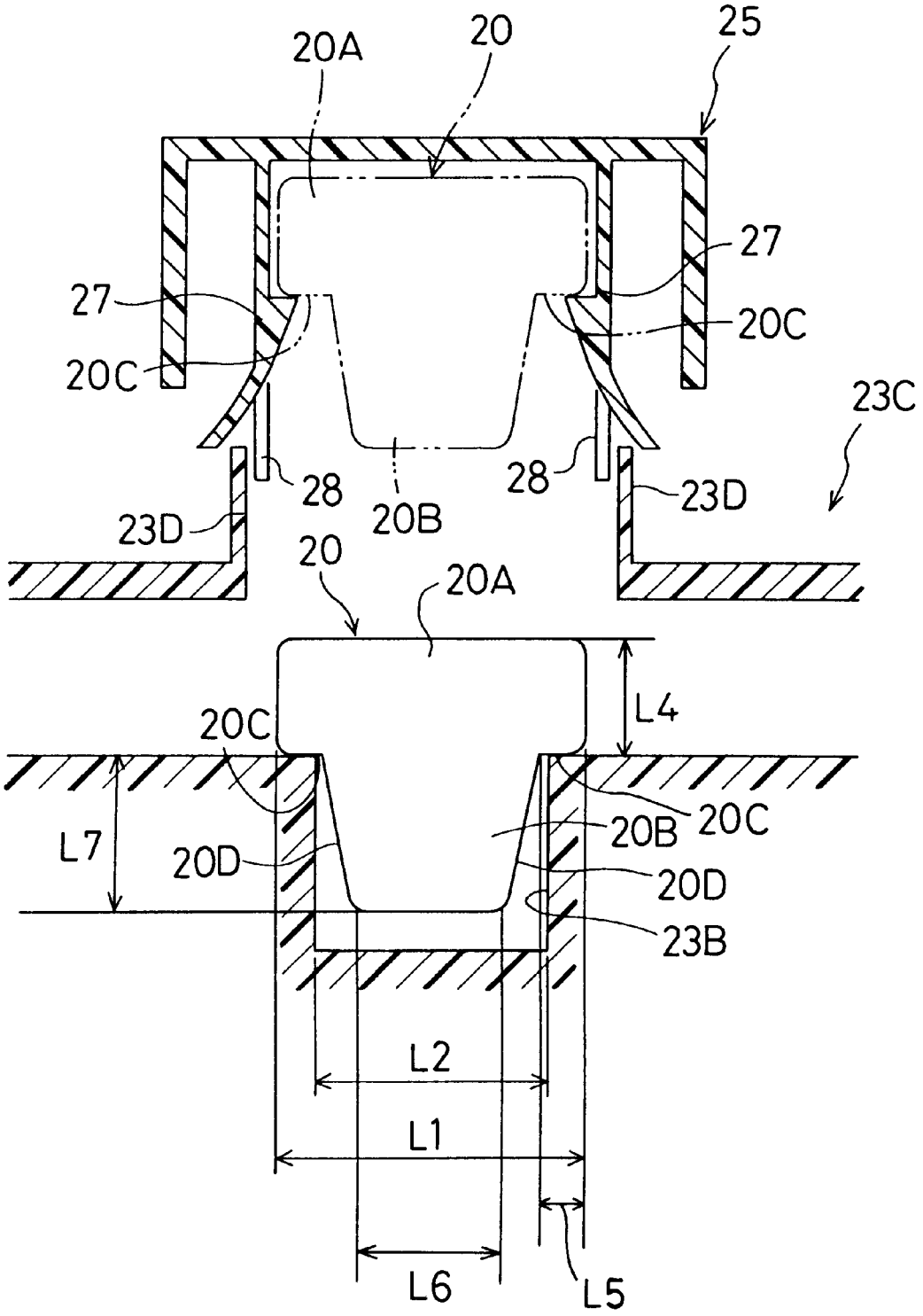
FIG. 2 is an explanatory view showing the ink pellet being moved from an ink holder to an insertion section.
Figure 4:
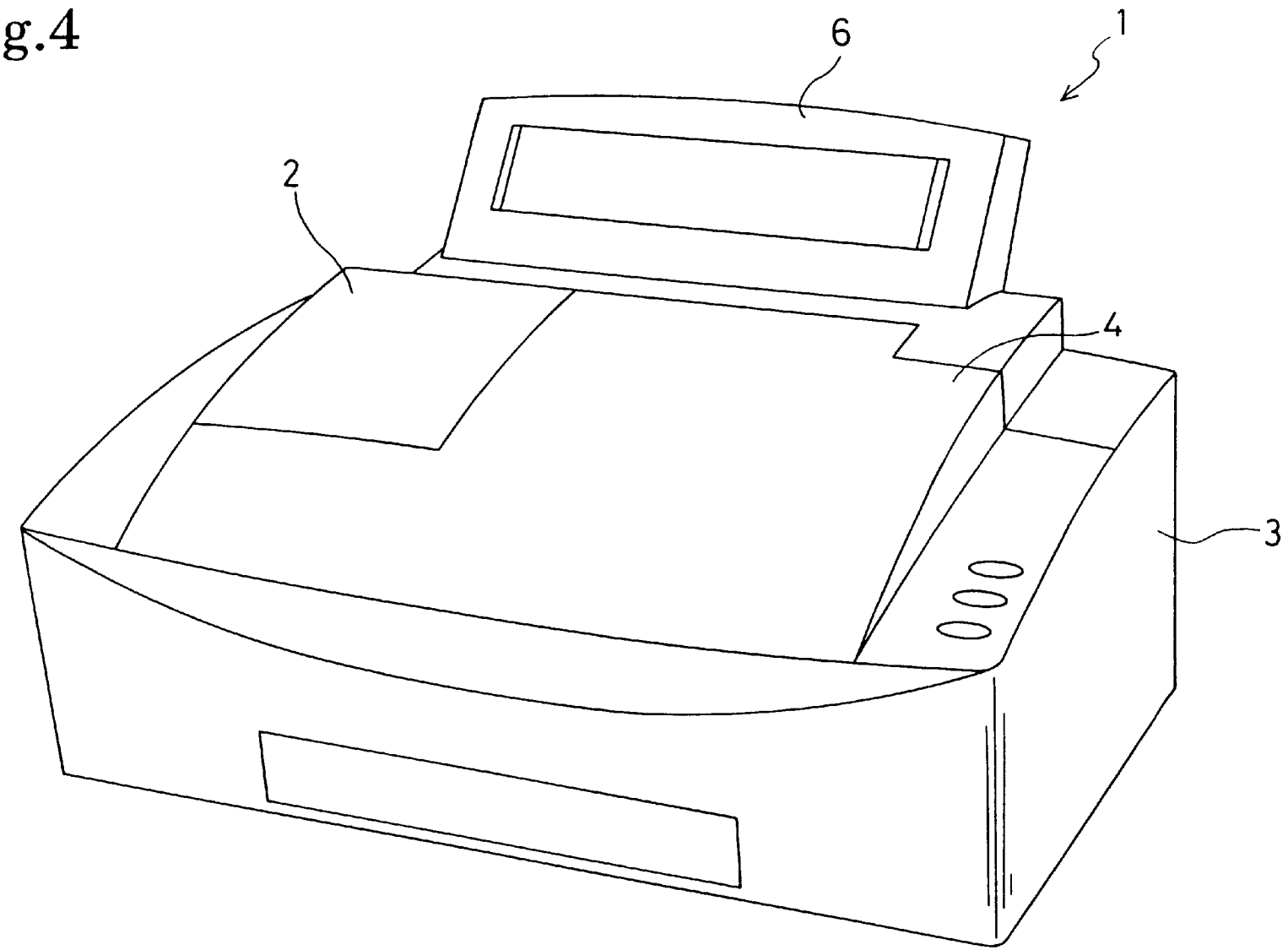
FIG. 4 is a front perspective view of an ink jet recording apparatus according to the invention.
Figure 5:
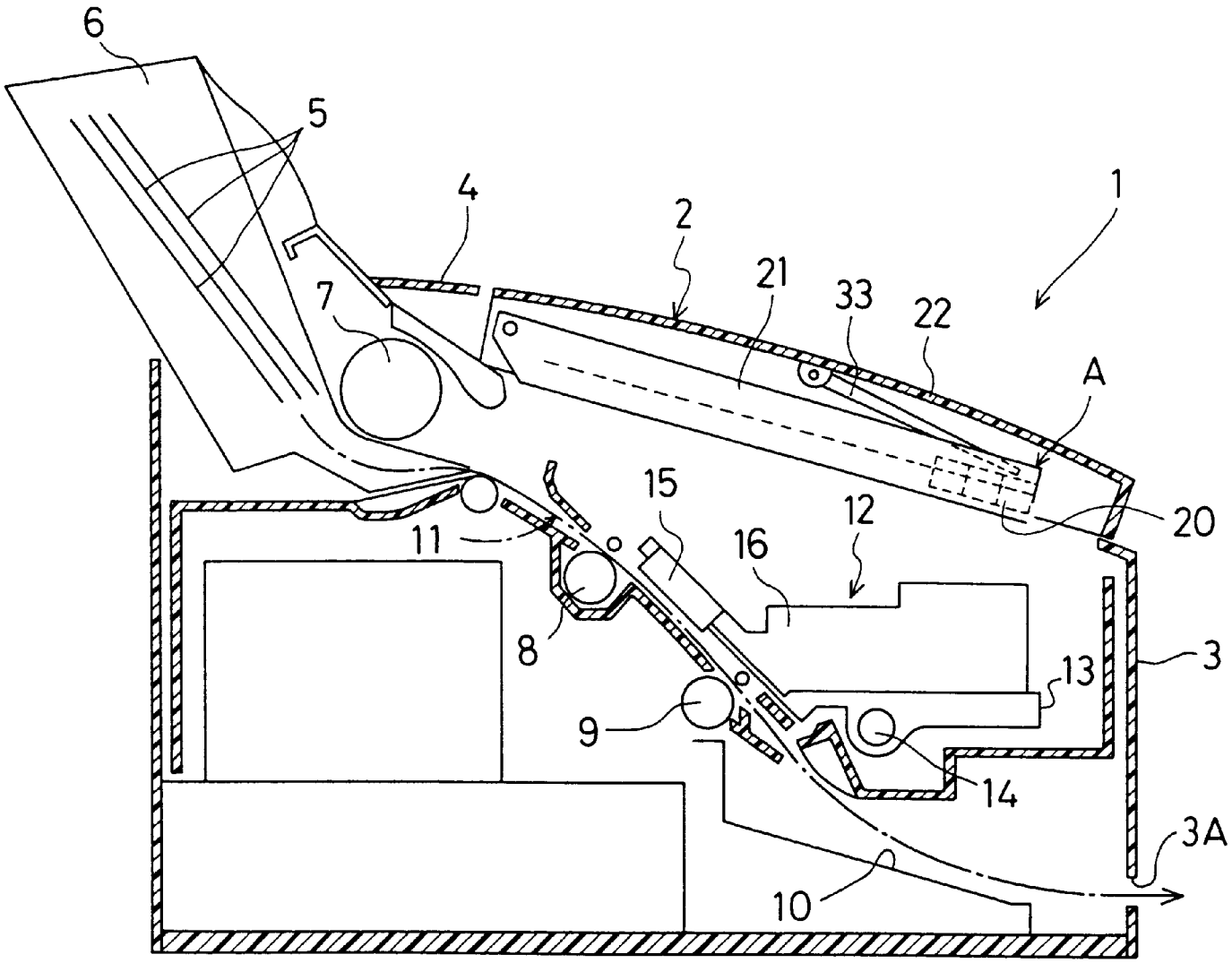
FIG. 5 is a schematic side view showing an internal arrangement of the ink jet recording apparatus of FIG. 4.

An ink pellet according to the preferred embodiment is supplied to an ink supplying apparatus 2 (shown in FIG. 4) from an ink holder 25 as shown in FIG. 2. The ink supplying apparatus 2 to which the ink pellet 20 is supplied is, as shown in FIG. 4, configured to form a portion of an upper cover 4 of an ink jet recording apparatus 1. The ink jet recording apparatus 1 includes a lower cover 3 and the upper cover 4 forming a box. A feed mechanism 6 is provided at the rear side of the upper cover 4 and is capable of accommodating a large number of stacked sheets of paper 5. As shown in FIG. 5, a feed roller 7 is disposed in the vicinity of a lower end portion of the feed mechanism 6. The feed roller 7 feeds the paper 5 accommodated in the feed mechanism 6 to a transport path 11.

The above-mentioned transport path 11 includes sequentially a first transport roller 8, a second transport roller 9, a discharge tray 10 and a discharging opening 3A, in order from the side of the feed mechanism 6. The paper 5 is moved continuously or intermittently by the first and second transport rollers 8 and 9 in a direction shown by the arrow in FIG. 5 (the sub-scanning direction) to be discharged from the apparatus through the discharging opening 3A.

A recording head mechanism 12 is disposed on the transport path 11 on the side of the upper cover 4. The recording head mechanism 12 includes a head section 15 opposed to the transport path 11 (and the paper 5 thereon), a tank section 16 for accommodating hot melt ink supplied to the head section 15 and a heater section (not shown) for heating the hot melt ink accommodated in the tank section 16 to melt the hot melt ink. The head section 15 has a large number of nozzles arranged in a sub-scanning direction from which ink droplets formed of liquid hot melt ink are ejected.

The recording head mechanism 12 further includes a carriage 13 for supporting the head section 15, the tank section 16, a guide member 14 for supporting the carriage 13 so as to be movable in a main-scanning direction perpendicular to the sub-scanning direction and a moving mechanism (not shown) for reciprocatingly moving the carriage 13 in the main-scanning direction along the guide member 14. The recording head mechanism 12 performs a printing operation for one band by spraying ink droplets at a predetermined print timing onto the paper 5 from the head section 15 which moves with the carriage 13 as the carriage 13 is moved in the main-scanning direction.

It should be noted that the above-mentioned term "hot melt ink" is the general term for an ink which is solid at room temperature and yet jettable in liquid form after heating. For example, the hot melt ink preferably has the following characteristics: the softening point is 40–140° C.; the melting point is 50–150° C.; and the ink viscosity when ejected as ink is 3–50 cps. Preferably the hot melt ink includes 30–90% wax, 5–70% resin, 0.1–10% colorant and other additives such as a viscosity-adjusting agent, a surfactant, and/or a solubilizer. However, other combinations of ingredients may be utilized.

The ink supplying apparatus 2 is provided at the upper portion of the recording head mechanism 12. The ink supplying apparatus 2 discharges an ink pellet 20 formed of solid hot melt ink from a supplying section A at the front side of the ink supplying apparatus 2 to the tank section 16. The ink supplying apparatus 2 includes an ink case 21 for accommodating the ink pellet 20 and a cover member 22 pivotally supported at one end portion of the ink case 21. The cover member 22 openly covers the ink case 21.

The ink case 21 includes accommodating channel sections 23 arranged in a row so as to respectively correspond to yellow (Y), magenta (M), cyan (C) and black (K), all of which are ink colors used in a color ink jet recording apparatus. Each of the accommodating channel sections 23 has a discharging section 23A for discharging the ink pellet 20 to the tank section 16 shown in FIG. 5, a pellet supporting channel 23B for supporting a plurality of ink pellets 20 so as to be movable toward the discharging section 23A and an insertion section 23C for inserting the ink pellet 20 into the pellet supporting channel 23B. These sections 23A, 23B and 23C are arranged in this order from the side of the supplying section A.

Figure 7:
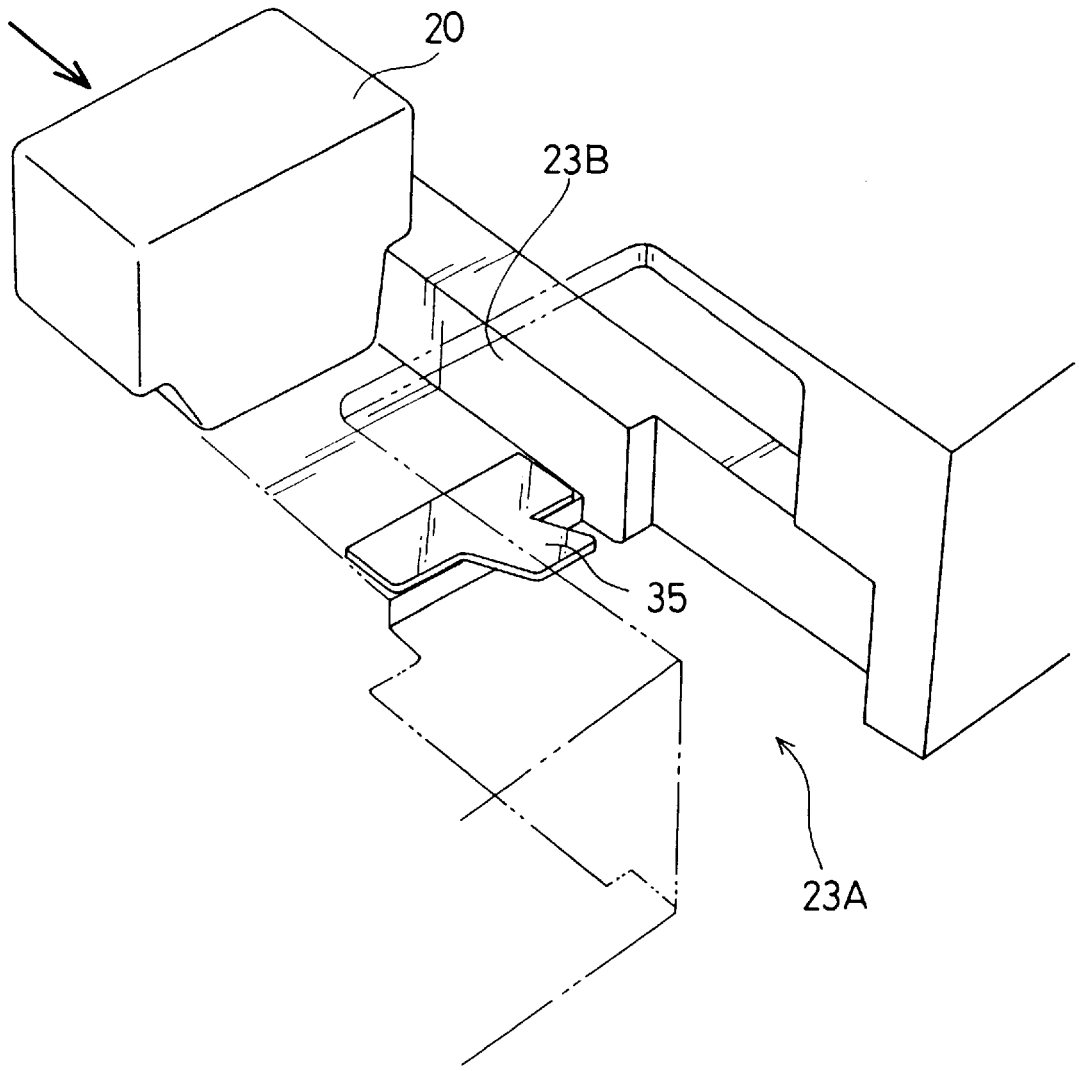
FIG. 7 is an explanatory view showing the ink pellet being moved to a discharging section.
Figure 8:
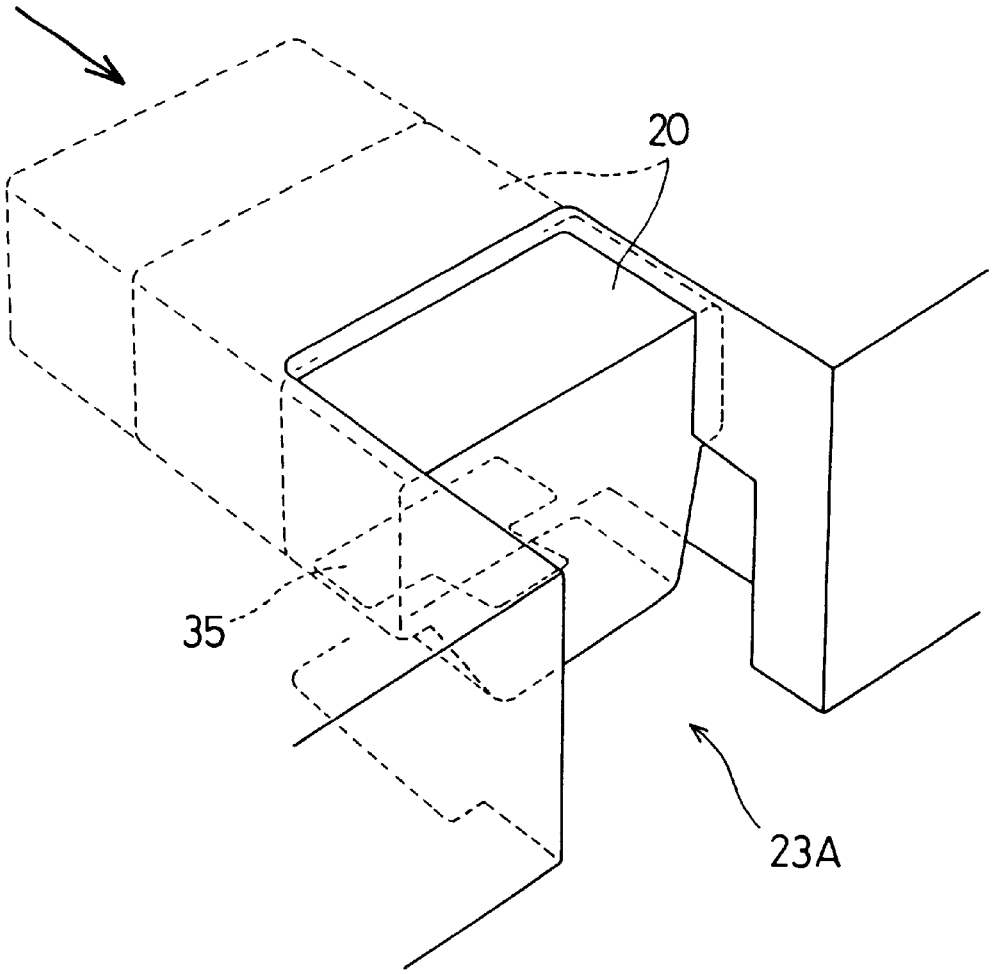
FIG. 8 is an explanatory view showing the ink pellet being supported at the discharging section.

The discharging section 23A arranged at the side of the supplying section A is open from an upper surface to a lower surface, as shown in FIGS. 7 and 8. A pellet supporting plate 35 is provided at the lower surface of the discharging section 23A. One end of the pellet supporting plate 35 is fixed to a bottom surface of the pellet supporting channel 23B. The pellet supporting plate 35 supports the ink pellet 20, which is moved to the discharging section 23A with the pellet supporting plate 35 in contact with a lower surface of the ink pellet 20.

Figure 10:
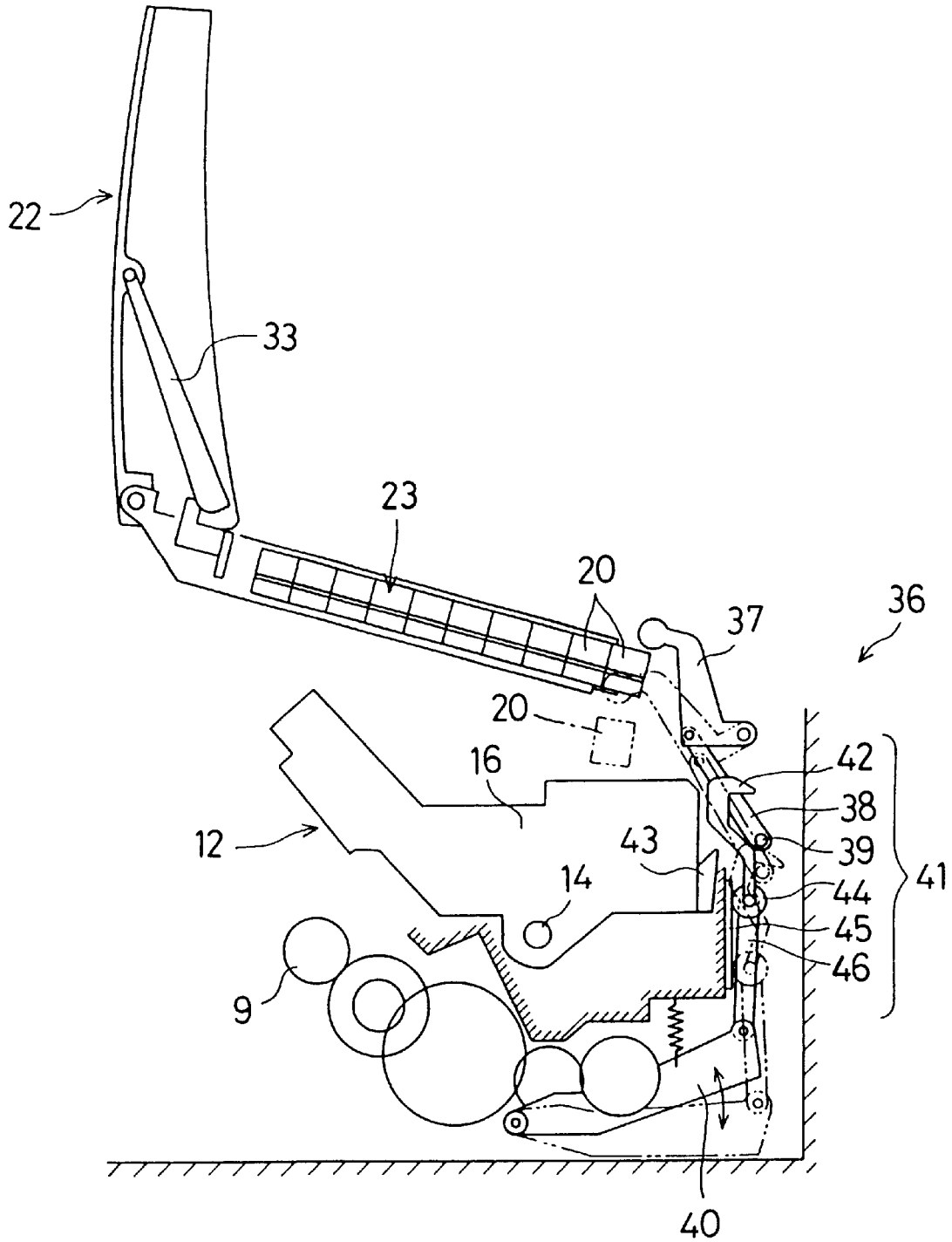
FIG. 10 is a schematic side view showing the ink pellet being discharged by a discharging mechanism according to the invention.
Figure 11:
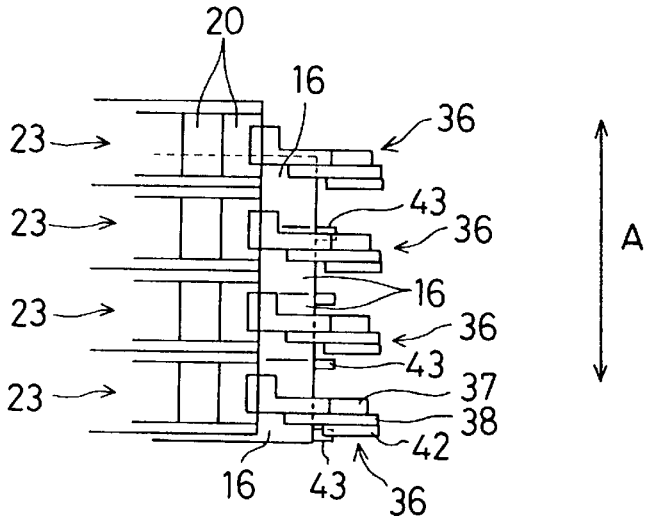
FIG. 11 is an upper view of the ink supplying apparatus according to the invention.

The ink pellet 20 supported by the discharging section 23A is pressed downwardly by a discharging mechanism 36 to be discharged, as shown in FIG. 10 and FIG. 11. The discharging mechanism 36 is disposed respectively corresponding to each accommodating channel section 23 and includes a first pivot member 37 for pressing the upper surface of the ink pellet 20 downwardly upon pivoting. The first pivot member 37 is connectable to a second pivot member 40 via a pivot control mechanism 41. The second pivot member 40 is pivoted up and down (in the direction shown by an arrow in FIG. 10) by an LF motor (not shown) and rotatably drives the first and second transport rollers 8 and 9.

The pivot control mechanism 41 includes a first connecting member 38, one end of which is pivotally connected to the first pivot member 37, an engagement member 39 provided at a free end of the first connecting member 38 and a key member 42 which is engagable with the engagement member 39. The key member 42 is configured in the shape of a key so as to engage with the engagement member 39 at its free end. The leading edge of the key member 42 is designed to not contact with the engagement member 39 when the key member 42 is only moved up and down with respect to FIG. 10.

A pinion member 44 is rotatably mounted at the fixed end of the key member 42. The pinion member 44 supports the free end of the key member 42 so as to be laterally pivotable. The pinion member 44 is meshed with a rack member 45 arranged longitudinally on the inner wall surface. The pinion member 44 and the rack member 45 control the movement of the key member 42 in the up and down direction with respect to FIG. 10. A second connecting member 46 is connected to the fixed end of the key member 42. The second connecting member 46 is pivotally connected to the free end of the second pivot member 40.

The key member 42 is disposed so as to be capable of contacting with a supply selecting member 43 which is fixed to the side of the tank section 16 for laterally moving the key member 42 when in contact with the key member 42. The pivot control mechanism 41 having the aforesaid structure operates as follows. If the key member 42 does not contact with the supply selecting member 43 when the second pivot member 40 pivots to downwardly move the key member 42, the key member 42 does not engage the engagement member and the first pivot member 37 is not pivoted. On the other hand, when the key member 42 contacts with the supply selecting member 43, the key member 42 laterally pivots into engagement with the engagement member 39 to downwardly pivot the first pivot member 37.

A supply selecting member 43 is provided on the tank section 16 for each color, as shown in FIG. 11. The supply selecting members 43 are arranged along the tank section 16 so that, when a particular supply selecting member 43 is in contact with the key member 42 of a particular discharging mechanism 36, the other supply selecting members 43 do not contact with the key member 42 of the other discharging mechanisms 36. Accordingly, the supply selecting member 43 discharges the ink pellet 20 only from the accommodating channel section 23 corresponding to the tank section 16 to which ink is to be supplied.

The ink pellet 20 discharged by the discharging mechanism 36, as described above, comprises hot melt ink in a solid form, as shown in FIG. 1. The hot melt ink is an amount capable of printing one page or more, and is an amount which will be consumed under normal conditions of use and will not significantly deteriorate while in the tank section 16. The ink pellet 20 includes, as shown in FIGS. 1 and 2, an upper contacting portion 20A having a width of L1 which is slightly greater than the width L2 of the pellet supporting channel 23B and a pellet main body 20B formed to produce step portions 20C, 20C at both sides of the lower surface of the upper contacting portion 20A. The step portions 20C, 20C contact the upper surf ace of the pellet supporting channel 23B to support the ink pellet 20.

Figure 3:
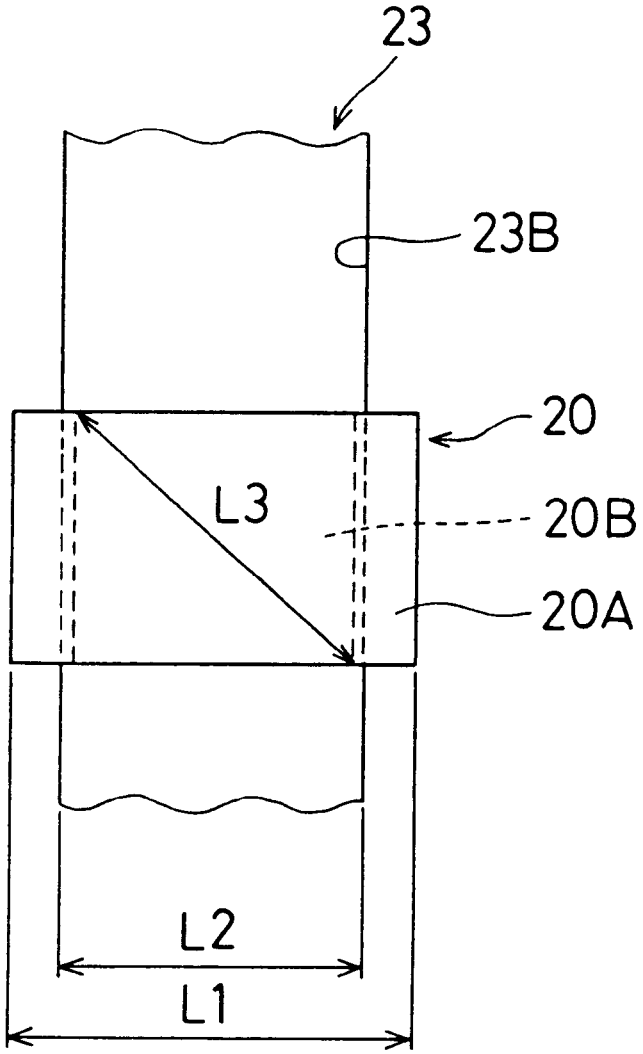
FIG. 3 is an explanatory view showing a relationship between the ink pellet and an accommodating channel section according to the invention.

The pellet main body 20B is formed to have a width smaller than the channel width L2 of the pellet supporting channel 23B so as not to contact with the pellet supporting channel 23B when supported by the step portions 20C, 20C, and a height smaller than the channel depth of the pellet supporting channel 23B. Further, both sides 20D, 20D of the pellet main body 20B symmetrically incline such that the width thereof becomes gradually smaller from its upper surface to its lower surface. Accordingly, even when the ink pellet 20 jerks from side to side when moved, increased frictional resistance does not occur caused by contact of the side surfaces 20D, 20D of the pellet main body 20B with the side wall surfaces of the pellet supporting channel 23B. Moreover, the pellet main body 20B is formed, as shown in FIG. 3, to have a rectangular cross-section. A diagonal distance L3 of the cross-section is configured to be greater than the channel width L2 of the pellet supporting channel 23B so that the orientation of the ink pellet does not greatly change due to contact of corner portions with the side wall surfaces of the pellet supporting channel 23B.

It is preferable that the diagonal distance L3 of the cross-section of the pellet main body 20B be greater than the channel width L2 of the pellet supporting channel 23B by approximately 0.5 mm or more. Further, it is preferable that the width L1 of the ink pellet 20 is configured such that an angle formed by the side surface 20D of the ink pellet 20 and the step portion 20C thereof is spaced apart from the side wall surface of the pellet supporting channel 23B by approximately 1 mm or more, as shown in FIG. 2. This structure reduces the frequent contact of the side surfaces or corner portions of the ink pellet 20 with the side wall surfaces of the pellet supporting channel 23B at the time of moving, even if the ink pellet 20 is somewhat deformed. This prevents rotation of the ink pellet due to the breakdown or abrasion of the ink pellet 20 and reduces the frictional force caused by the contact, whereby allowing smooth movement of the ink pellet along the ink accommodating channel 23. Additionally, it is preferable that the ink pellet 20 be formed such that the center of gravity of the ink pellet 20 is within the pellet main body 20B in order to prevent the ink pellet from falling over as it is moved along the ink accommodating channel 23.

A preferred size of the ink pellet 20 will be explained with reference to FIGS. 1 and 2. The width L1 of the upper contacting portion 20A of the ink pellet 20 is preferably approximately 16.7 mm and the channel width L2 of the pellet supporting channel 23B is preferably approximately 14.8 mm. The diagonal distance L3 of the upper cross-section of the pellet main body 20B is preferably approximately 19 mm and a depth of the upper contacting portion 20A is preferably approximately 12.4 mm. A height L7 of the pellet main body 20B of the ink pellet 20 is preferably approximately 7 mm, a height L4 from the step portion 20C to the upper contacting portion 20A of the ink pellet 20 is preferably approximately 8.6 mm and a width L6 of the lower surface of the pellet main body 20B is preferably approximately 12 mm. A width L5 of the step portion 20C of the ink pellet 20 is preferably approximately 1.05 mm. These dimensions are merely preferable and exemplary, and are not intended to be limiting.

Figure 12:
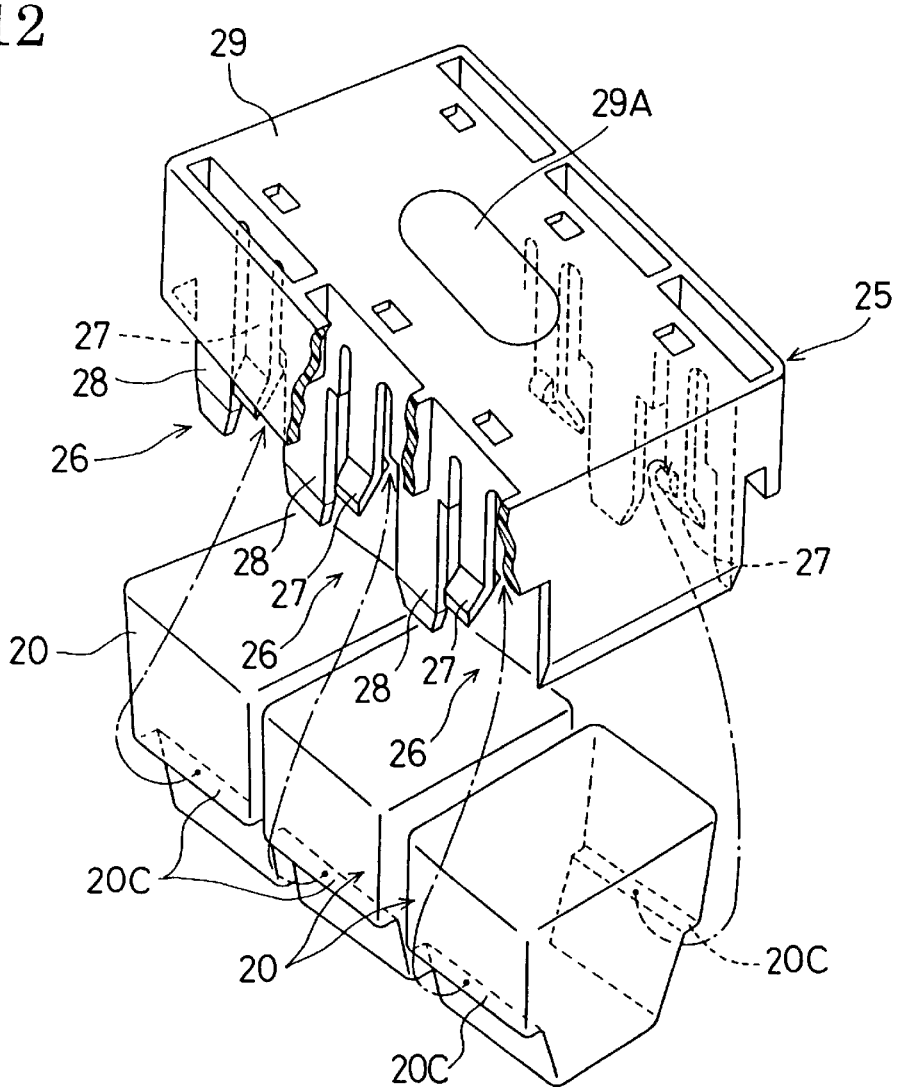
FIG. 12 is an explanatory view showing the ink pellet being placed into an ink holder according to the invention.

As shown in FIG. 12, the ink pellet 20 is removably accommodated in an ink holder 25 so as not to be touched by an operator when handled thereby. The ink holder 25 has a holder main body 29, which is open on one side (the lower surface in FIG. 12), into which the ink pellet 20 is inserted and a supporting mechanism for supporting a plurality of the ink pellets 20 within the holder main body 29. A pressing concave 29A is formed at the center portion of the other side (the upper surface in FIG. 12) of the holder main body 29. The pressing concave 29A serves as a guide for a user, that is, when a user presses on the pressing concave 29A the pressing force is distributed to discharge each of the ink pellets 20 accommodated within the ink holder 25.

Figures 6A, 6B:
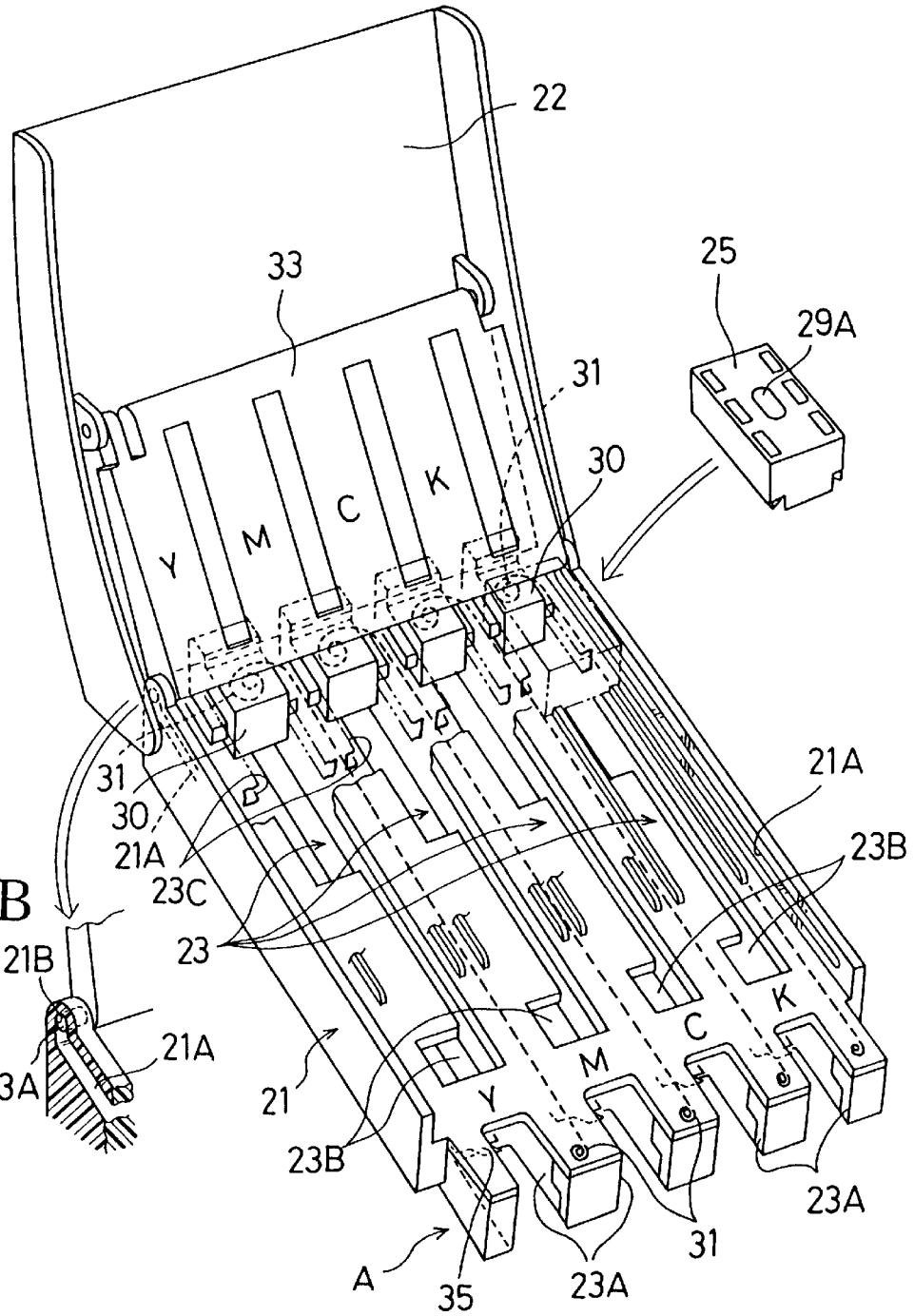
FIG. 6A is a front perspective view of an ink supplying apparatus according to the invention.
FIG. 6B is a sectional view of a portion of the ink supplying apparatus of FIG. 6A.
Figure 13:
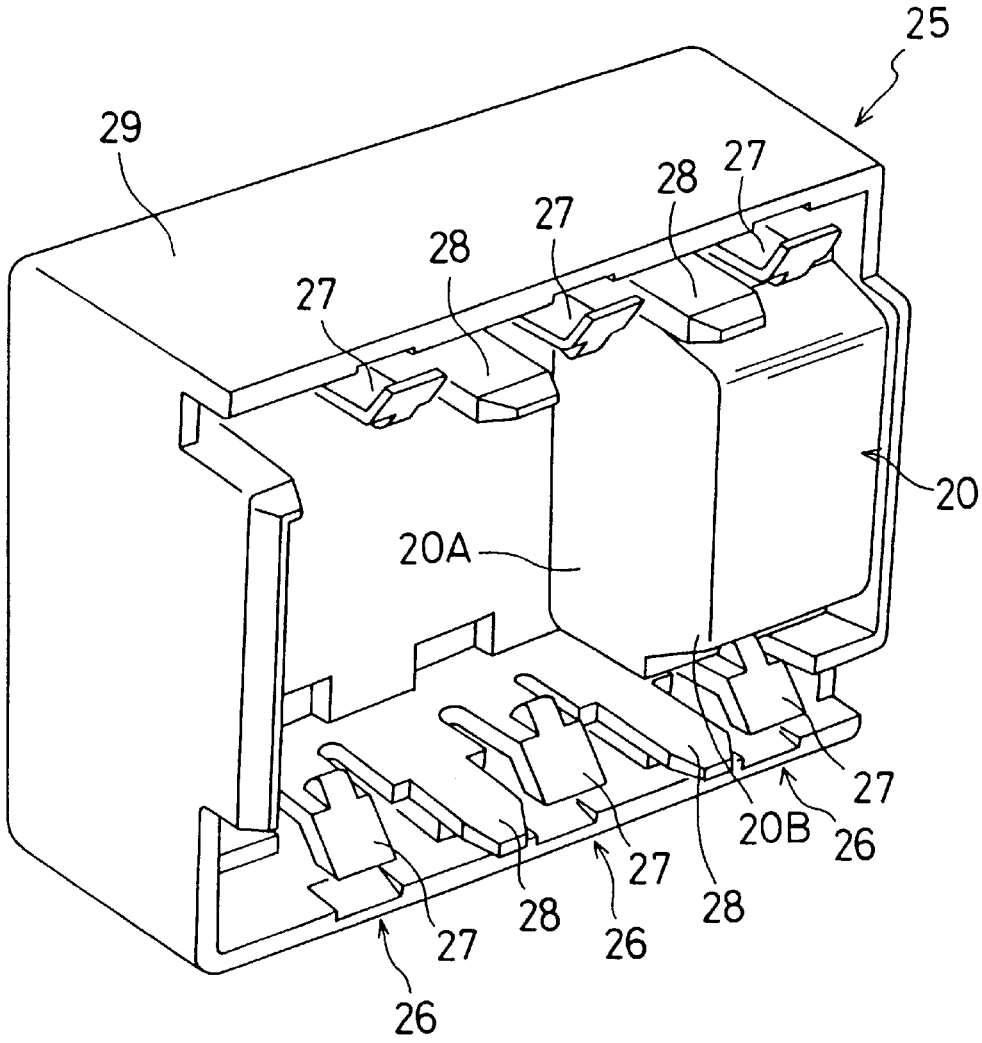
FIG. 13 is an explanatory view showing the ink pellet accommodated within an ink holder.

On the other hand, the supporting mechanism includes, as shown in FIG. 13, a plurality of supporting sections 26 each arranged in series so as to move along the accommodating channel section 23 shown in FIG. 6A. Each supporting section 26 has a pair of claw members 27, 27, which engage with the step portions 20C, 20C of the ink pellet 20. As shown in FIG. 2, the claw members 27, 27 engage with the step portions 20C, 20C to support the ink pellet 20 when the upper contacting portion 20A of the ink pellet 20 is inserted into the ink holder 25.

The ink holder 25 is placed into the insertion section 23C of the accommodating channel section 23, as shown in FIG. 6A. The insertion section 23C is provided with an engagement releasing member 23D, as shown in FIG. 2, which projects upward and corresponds to the claw member 27 of the ink holder 25. The engagement releasing member 23D pushes open the claw members 27, 27 to release the ink pellet 20 from the ink holder 25, whereby the ink pellet 20 falls due to gravity from the ink holder 25 into the pellet supporting channel 23B. It is preferable that the ink holder 25 be provided with a key section, or protrusion and the corresponding insertion section 23*c* be provided with a key channel section, or matching groove of the same respective colors so that a user can identify and place the ink holder 25 for an ink of a predetermined color into the insertion section 23C of the accommodating channel section 23 which corresponds to the ink holder 25 of the predetermined color.

The supporting section 26 of the ink holder 25 has a plate-like guide member 28 formed between the adjacent supporting sections 26 as shown in FIGS. 12 and 13. The guide member 28 is configured to contact the side surface of the ink pellet 20. The guide member 28 contacts the side surface of the upper contacting portion 20A upon movement of the ink pellet 20 toward the pellet supporting channel 23B, thereby maintaining the orientation of the ink pellet 20.

The ink pellet 20 having been moved to the pellet supporting channel 23B as described above is, as shown in FIG. 15, urged toward the discharging section 23A by an urging mechanism provided with a pellet pressing member 30 and an urging member 31. An urging mechanism is mounted in each accommodating channel section 23. The pellet pressing member 30 is movable along the pellet supporting channel 23B so as to contact the side surface of the ink pellet 20. The urging member 31 may include a coil spring for producing a stabilized urging force. The center of the spring is fixed to the pellet pressing member 30 and the leading edge thereof is fixed to the discharging section 23A of the accommodating channel section 23.

A projecting member 32 is provided on the upper surface of the pellet pressing member 30. A free end of a link member 33 contacts with the projecting member 32.

Figure 14:
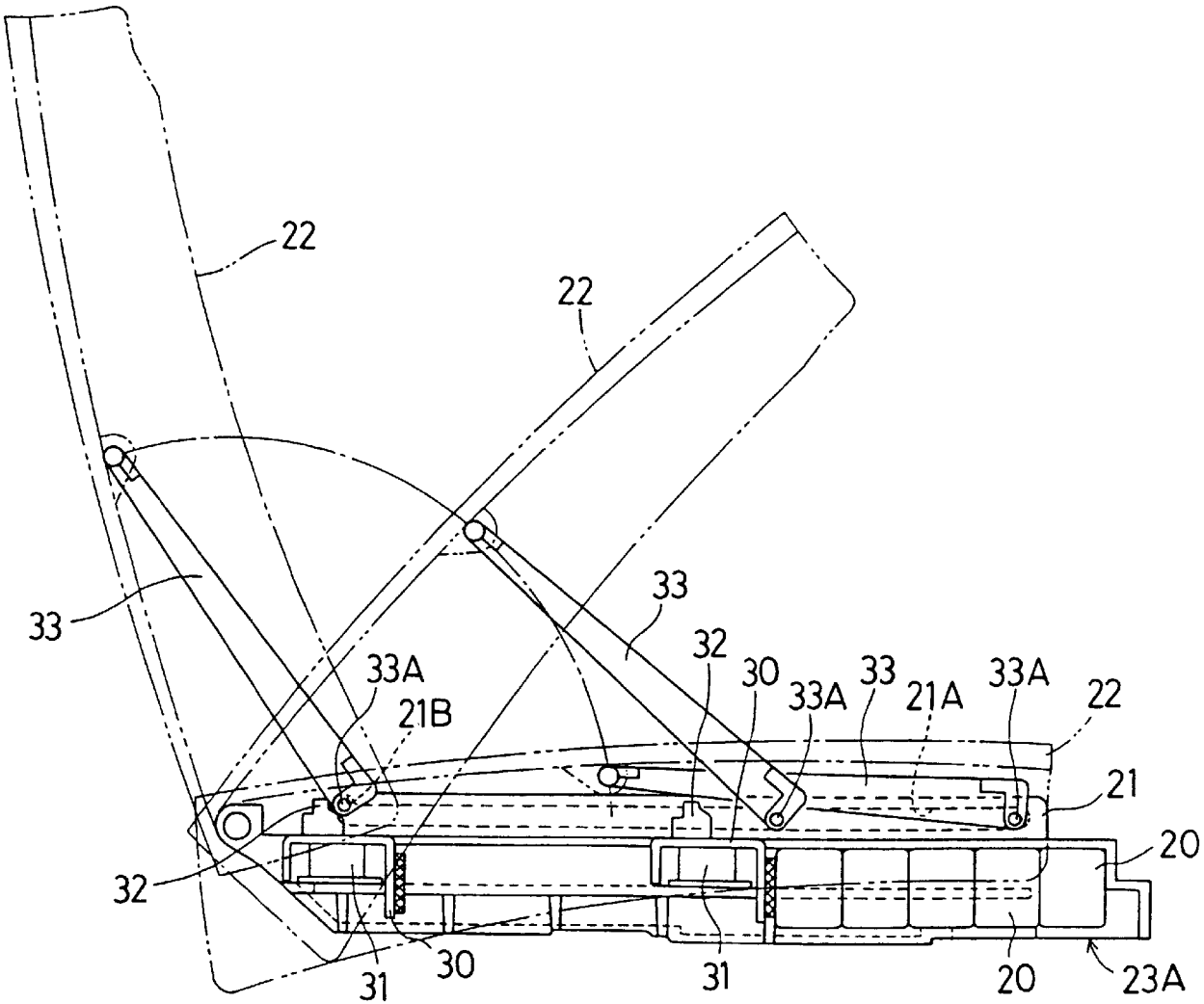
FIG. 14 is an explanatory view showing a cover member being pivoted according to the invention.

The link member 33 preferably has a width slightly smaller than the distance between the side wall surfaces of the ink case 21 so as to contact with the projecting members 32 of all of the accommodating channel sections 23, that is, the accommodating channel section 23 for each of the respective colors. As shown in FIG. 14, insertion pegs 33A are formed at both sides of the free end of the link member 33. The insertion pegs 33A are movably engaged within guide slots 21A formed on both side walls of the ink case 21.

The guide slot 21A is, as shown in FIG. 6B, formed linearly from the discharging section 23A to the insertion section 23C of the accommodating channel section 23, and then connected to a stopper slot 21B bent upward at the insertion section 23C. The fixed end of the link member 33 is pivotally supported at approximately the center portion of the cover member 22. With this structure, the fixed end of the link member 33 is pulled up when the cover member 22 is pivoted open, and the free end moves along the guide slot 21A toward the insertion section 23C contacting with all of the projecting members 32 to thereby advance the projecting members 32 toward the insertion section 23C along with the pellet pressing members 30. When the link member 33 is fully opened, the insertion peg 33A is pulled up into the stopper slot 21B to fix the link member 33 in place so that the pellet pressing member 30 is supported while the cover member 22 is kept open.

Color indications ("Y", "M", "C", "K") showing the color of each ink are marked on the upper surface of the link member 33. The color indications ("Y", "M", "C", "K") are visible from outside of the accommodating channel section 23 and prevent working errors which may occur when the supply of the ink pellets 20 in the accommodating channel section 23 is replenished. The color indications may alternatively or additionally be marked on the cover member 22.

Figure 16:
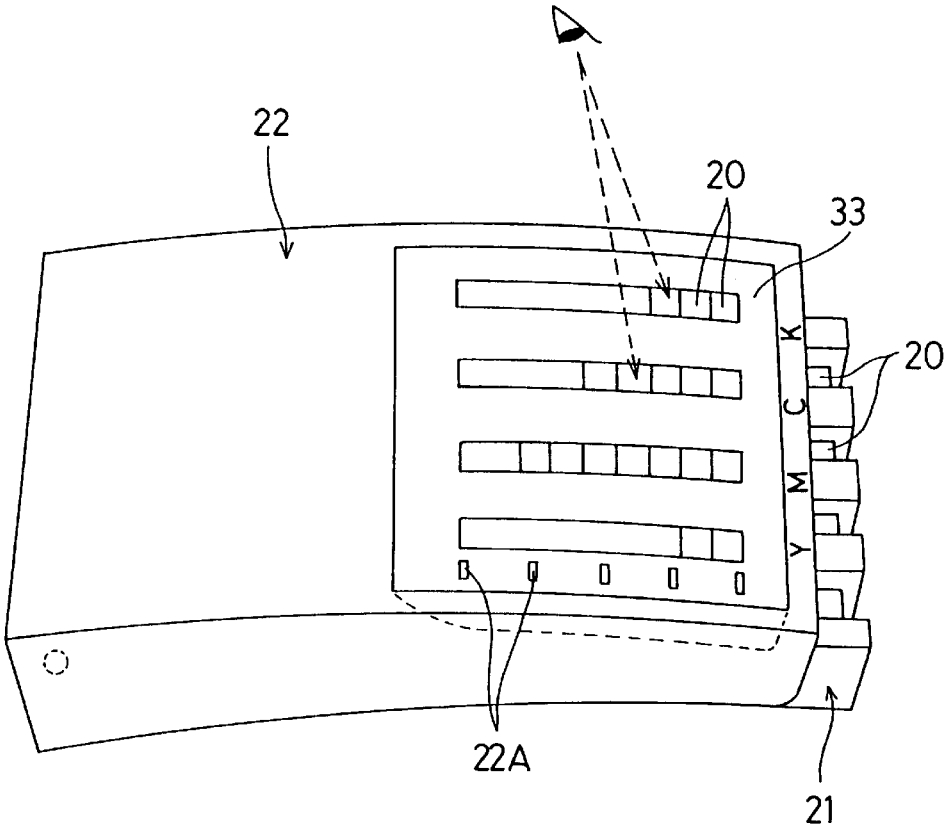
FIG. 16 is a side perspective view of a cover member according to the invention.
Figure 17:
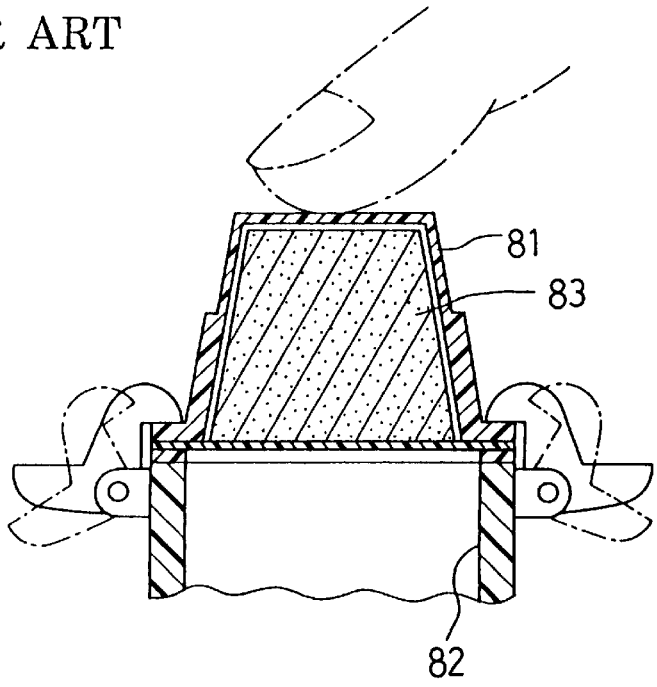
Fig.17 PRIOR ART
FIG. 17 is a explanatory view showing an ink pellet according to the prior art.
Figure 18:
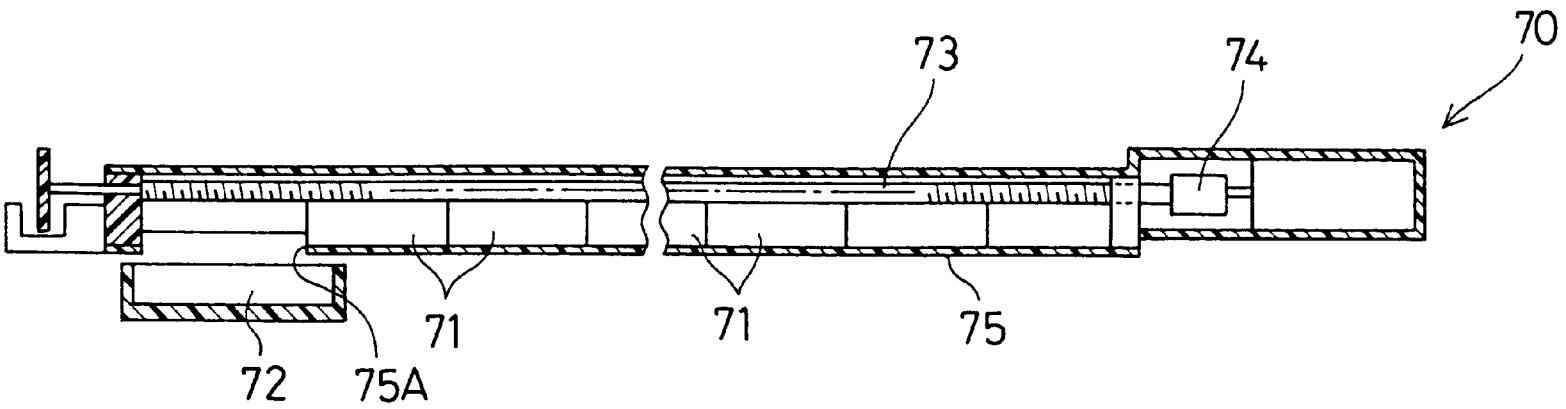
Fig.18 PRIOR ART
FIG. 18 is a longitudinally sectional view showing an ink supplying apparatus according to the prior art.

The cover member 22, as shown in FIG. 16, may be made of a material having transparency so that the supply of ink pellets 20 within the accommodating channel section 23 can be viewed from outside of the apparatus. Scales 22A may be marked on the surface of the cover member 22. The scales 22A indicate the number of the ink pellet 20 accommodated in the accommodating channel section 23. The scales 22A are arranged such that the operator can determine the remaining number of ink pellets by viewing the scales from the outside. Alternately, the scales 22A may be formed on the ink case 21. The cover member 22 may further include an open, or transparent window which extends along the accommodating channel section 23. In this case, it is unnecessary to use the transparent material for the cover member 22.

An operation of the ink supplying apparatus 2 using the ink pellet 20 shown in FIGS. 1 and 2 will be explained hereinbelow.

First, fused hot melt ink of each ink color (yellow, magenta, cyan, black) is solidified using a mold to form the ink pellet 20 having the shape shown in FIG. 8. Thereafter, the ink pellet 20 is inserted into the ink holder 25, as shown in FIGS. 12 and 13, for preventing stains or grease from being adhered to the ink pellet 20 due to the direct touch of the ink pellet 20 by an operator. When the ink pellet 20 is inserted into the ink holder 25, the claw member 27 of the ink holder 25 engages with the step portion 20C of the ink holder 25 and holds the ink pellet 20 to the ink holder 25 such that the ink pellet 20 does not change its orientation within the ink holder 25 and does not fall out of the ink holder 25 even when shaken. Three ink pellets 20 inserted in the manner described above are supported in the ink holder 25 in series to be supplied by the operator as replenishing ink.

Next, as shown in FIG. 16, the number of the ink pellets 20 remaining within the accommodating channel section 23 can be confirmed by viewing the inside of the ink case 21 through the cover member 22 since the cover member 22 is transparent. The number of ink pellets 20 can be determined with reference to the scales 22A. When the number is the same as or smaller than a predetermined number, it is determined that the ink pellet 20 should be replenished. After the ink color is confirmed by the color indications, the ink pellet 20 of the confirmed ink color is replenished.

That is, the cover member 22 is pivoted to the open position as shown in FIG. 14. When the cover member 22 is pivoted, the fixed end of the link member 33 is pulled up and the insertion peg 33A at the free end moves along the guide slot 21A toward the insertion section 23C. When the insertion peg 33A moves toward the insertion section 23C, the free end of the link member 33 contacts with all of the projecting members 32 and the pellet pressing member 30 moves toward the insertion section 23C, that is, in a direction opposite to the urging direction of the urging member 31. When the link member 33 is fully opened, the insertion peg 33A is pulled up into the stopper slot 21B to fix the link member 33 so that the pellet pressing member 30 is fixed in the advanced position while the cover member 22 is open. Accordingly, the accommodating channel section 23 is exposed and simultaneously the urging is released by the movement of the pellet pressing member 30, thereby completing preparation for placing the ink pellet 20 into the accommodating channel section 23 by the one operation of opening the cover member 22.

When the cover member 22 is opened as described above, the ink holder 25 is, as shown in FIG. 6A, placed into the insertion section 23C of the accommodating channel section 23 according to the color indications marked on the cover member 22 or the link member 33. As shown in FIG. 2, when the ink holder 25 is pressed toward the insertion section 23C, the claw member 27 engaged with the step portion 20C of the ink pellet 20 is pushed open by the engagement releasing member 23D so that the ink pellet 20 drops by gravity into the pellet supporting channel 23B. Even if the ink pellet 20 pivots as it moves, the side surface of the ink pellet 20 contacts with the guide member 28 so that the orientation of ink pellet 20 within the ink holder 25 is maintained when it reaches the pellet supporting channel 23B. Accordingly, the step portion 20C of the ink pellet 20 assuredly contacts with the upper surface of the pellet supporting channel 23B to be supported thereby. Such structure reduces error in moving the ink pellet 20 from the ink holder 25 to the pellet supporting channel 23B. Since errors seldomly occur and three ink pellets 20 are simultaneously placed by one operation, the replenishing operation is quickly completed.

Figure 15:
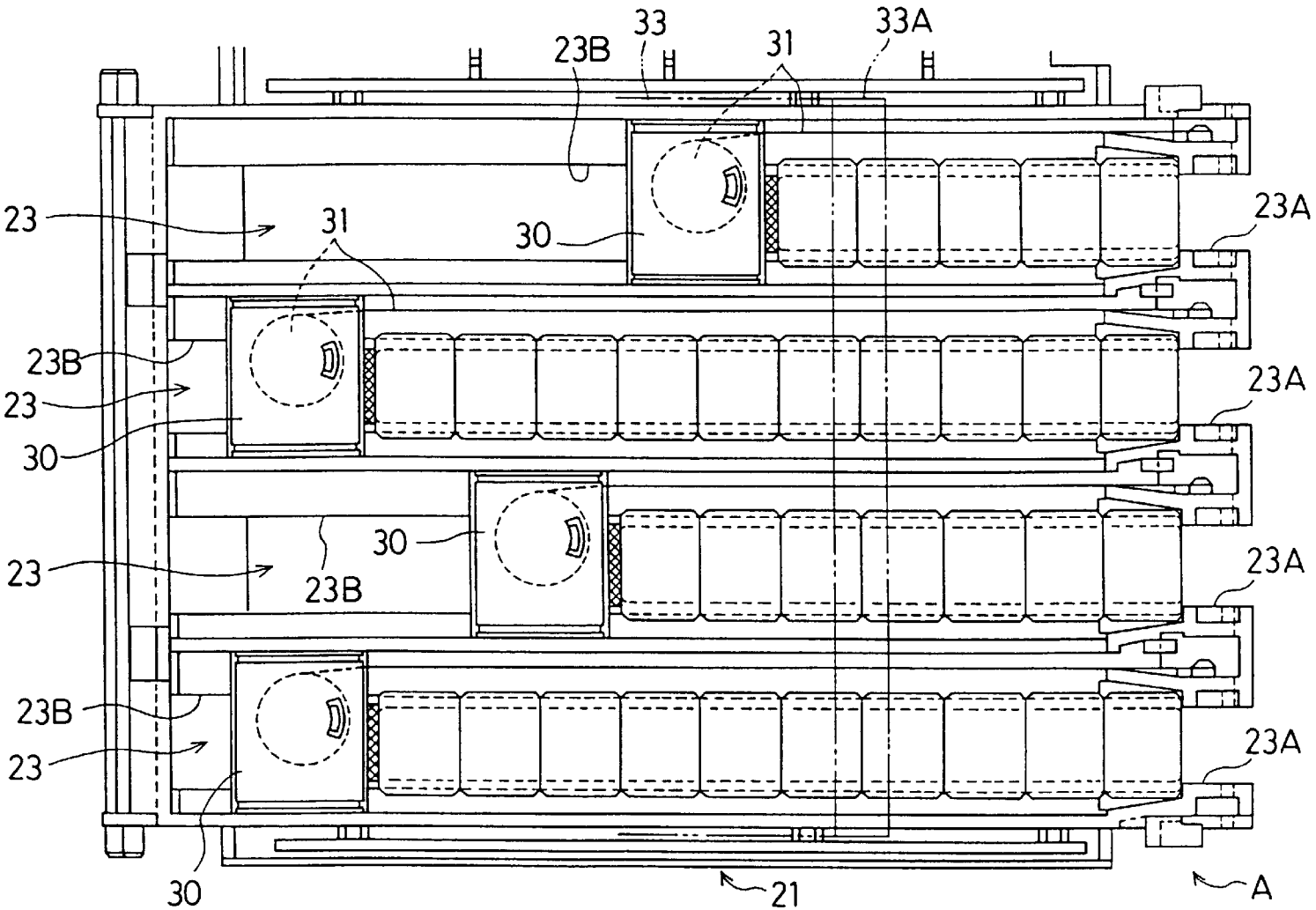
FIG. 15 is an explanatory view showing the ink pellet accommodated in each of the accommodating channel section.

When the ink pellet 20 is placed into the pellet supporting channel 23B, the cover member 22 is pivoted so as to cover the ink case 21, as shown in FIG. 14, such that the free end of the link member 33 is advanced toward the discharging section 23A. The pellet pressing member 30 supported by contact between the link member 33 and the projecting member 32 is moved toward the discharging section 23A by the urging member 31, whereby the ink pellet 20 in each of the accommodating channel sections 23 is moved respectively toward the discharging section 23A, as shown in FIG. 15.

The pellet main body 20B of the ink pellet 20 is formed such that, when supported by the step portion 20C as shown in FIGS. 2 and 3, the width thereof is smaller than the channel width L2 of the pellet supporting channel 23B and the height thereof is smaller than the channel height of the pellet supporting channel 23B. Further, the pellet main body 20B has a rectangular cross-section with the diagonal distance L3 is set to be greater than the channel width L2 of the pellet supporting channel 23B. Moreover, both side surfaces 20D, 20D of the pellet main body 20B are inclined such that the width of the pellet main body 20B becomes gradually smaller from its upper surface to its lower surface. Thus, even when the ink pellet 20 jerks from side to side when moved, increased frictional resistance does not occur caused by contact of the pellet main body 20B with the pellet supporting channel 23B and the orientation of the ink pellet 20 does not greatly change due to the contact of corner portions with the side wall surfaces of the pellet supporting channel 23B. As a result, the ink pellet 20 assuredly reaches the discharging section 23A with a predetermined orientation.

After the replenishment of the ink pellet 20 is completed as described above, the ink jet recording apparatus 1 is operated to start printing as shown in FIG. 5. When the hot melt ink in the tank section 16 is consumed and an ink empty condition is detected by an ink remaining amount sensor (not shown), the tank section 16 of the recording head mechanism 12 is moved in the direction shown by an arrow A in FIG. 11 to the supplying position to supply the ink pellet 20 to the tank section 16 which has come empty. When the supply selecting member 43 of the tank section 16 reaches the key member 42 of the discharging mechanism 36 corresponding to the tank section 16, the movement of the tank section 16 is terminated. Thereafter, the second pivot member 40 is pivoted in the direction shown by an arrow by the LF motor (not shown). When the second pivot member 40 is pivoted, the pinion member 44 is downwardly moved via the second connecting member 46 to move the key member 42 downward.

Figure 9:
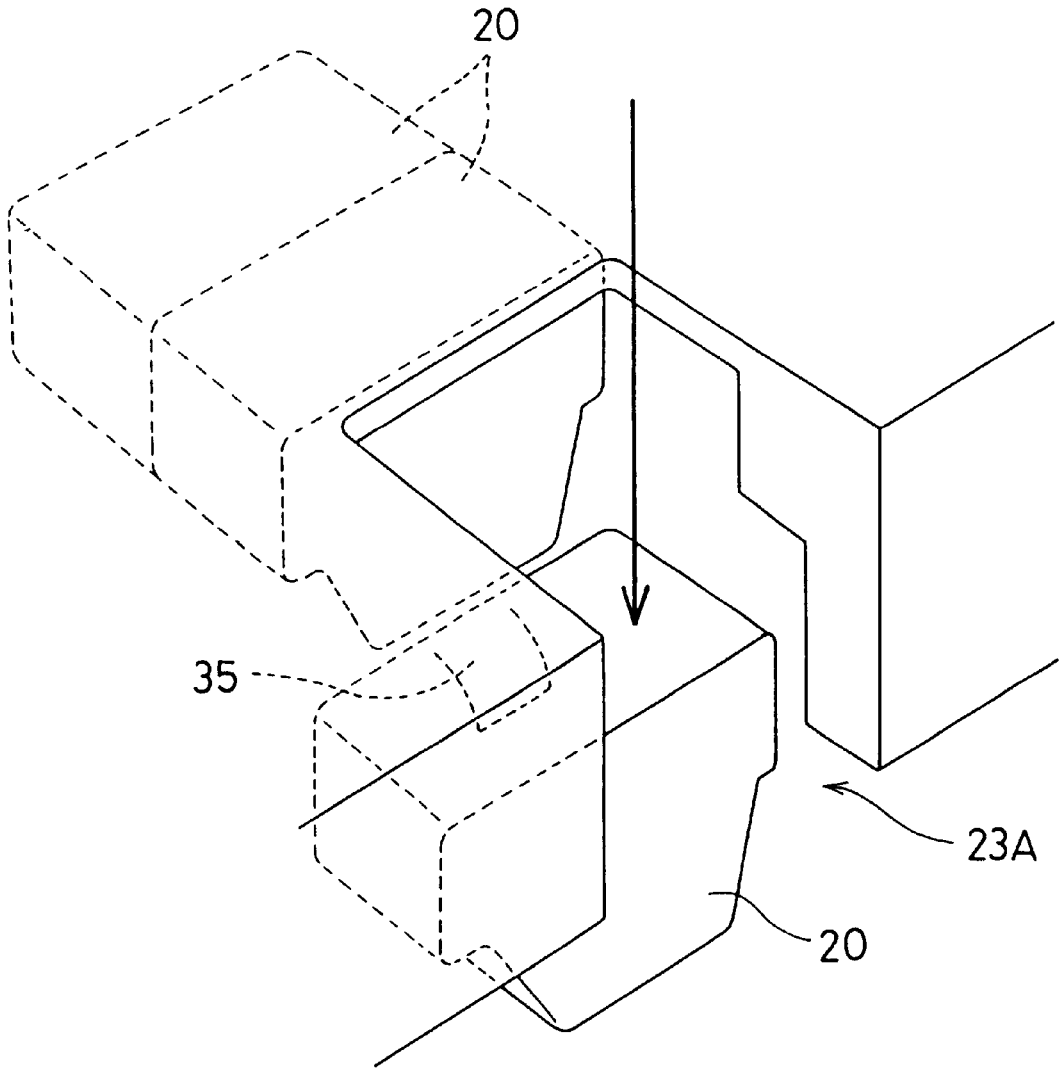
FIG. 9 is an explanatory view showing the ink pellet being discharged from the discharging section.

In the discharging mechanism 36 in which the supply selecting member 43 is positioned below the key member 42, the key member 42 contacts with the supply selecting member 43. The key member 42 laterally pivots to move downward for engaging with the engagement member 39, to thereby downwardly move the engagement member 39 and the first connecting member 38. By this movement, the first pivot member 37 is pivoted via the first connecting member 38 to press down the upper surf ace of the ink pellet 20 supported by the pellet supporting plate 35 of the discharging section 23A as shown in FIG. 9, whereby the ink pellet 20 falls down from the discharging section 23A to be inserted into the tank section 16. When the ink pellet 20 is discharged in this manner, the ink pellet 20 is moved along the pellet supporting channel 23B by urging force of the urging member 31 to be replenished to the discharging section 23A which has no ink pellet 20.

On the other hand, the key member 42 does not contact with the supply selecting member 43 in the non-selected discharging mechanism 36, whereby the key member 42 only moves downward so that it does not engage with the engagement member 39. Accordingly, the first pivot member 37, which is connected to the engagement member 39 via the first connecting member 38, does not discharge the ink pellets 20 in the discharge sections 23A corresponding to the non-selected discharging mechanisms 36. Thus, the ink pellet 20 is discharged only from the accommodating channel section 23 corresponding to the tank section 16 to be supplied by the supply selecting member 43 and the discharging mechanism 36, thereby preventing unnecessary supplying error of the ink pellet 20.

As described above, the ink pellet 20 of the preferred embodiment of the invention includes, as shown in FIG. 3, solid hot melt ink movably accommodated in the accommodating channel section 23 of an ink supplying apparatus relative to the tank section 16 so that a predetermined amount of the hot melt ink supplied to the tank section 16 is melted. The ink pellet 20 further includes the upper contacting portion 20A having the width L1 slightly greater than the channel width L2 of the accommodating channel section 23, and the pellet main body 20B having step portions 20C, 20C at both sides of the lower surface of the upper contacting portion 20A, a width smaller than the channel width L2 of the accommodating channel section 23 and a height smaller than the channel height of the accommodating channel section 23.

With this structure, the ink pellet 20 is supported by contact of the upper surface of the accommodating channel section 23 with the step portions 20C formed by the upper contacting portion 20A and the pellet main body 20B. The pellet main body 20B does not contact with the accommodating channel section 23 so that the contacting area is decreased compared to the case in which the pellet main body 20B contacts with the accommodating channel section 23. Accordingly, the frictional resistance due to movement of the ink pellet 20 is decreased so that the ink pellet 20 smoothly moves even with a small urging force. Therefore, the ink pellet 20 can be moved by utilizing a simple and compact mechanism, such as the urging member 31 shown in FIG. 6A, and a small-sized ink supplying apparatus 2 having simple structure can be realized using this ink pellet 20.

As described above, the ink pellet 20 of the preferred embodiment of the invention includes, as shown in FIG. 3, solid hot melt ink movably accommodated in the pellet supporting channel 23B of the accommodating channel section 23 of the ink supplying apparatus relative to the tank section 16 such that a predetermined amount of the hot melt ink is supplied to and melted by the tank section 16. Further, the ink pellet 20 is formed to have a rectangular cross-section with the diagonal distance L3 of the portion of the ink pellet 20, which is accommodated in the pellet supporting channel 23B, set to be greater than the channel width L2 of the pellet supporting channel 23B. Since the diagonal distance L3 of the ink pellet 20 is greater than the channel width L2 of the accommodating channel section, the ink pellet 20 will not change its orientation and clog the pellet supporting channel 23B due to the contact of the corner portion of the ink pellet 20 with the side wall surfaces of the pellet supporting channel 23B even when the ink pellet 20 is rotated during movement into the pellet supporting channel 23B.

Further, as described above, the ink holder 25 of the preferred embodiment of the invention is for replenishing the ink pellet 20 to the accommodating channel section 23. The ink holder 25 is provided with the supporting section 26 for supporting a plurality of ink pellets 20 and for moving the ink pellet 20 toward the accommodating channel section 23 when the ink holder 25 is placed into the accommodating channel section 23. The plurality of ink pellets 20 supported by the supporting section 26 are moved from the ink holder 25 into the accommodating channel section 23 by one operation of setting the ink holder 25 into the accommodating section 23. This facilitates the operation of inserting the ink pellet 20 and operation is performed in a short period of time.

While the invention has been described in conjunction with a specific embodiment thereof, it is evident that many alternatives, modifications and variations may be apparent to those skilled in the art. Accordingly, the preferred embodiment of the invention as set forth herein is intended to be illustrative, not limiting. Various changes may be made without departing from the spirit and scope of the invention as defined in the following claims.

What is claimed is:

1. An ink pellet assembly including an ink pellet formed of solid hot melt ink and configured for storage and movement in an accommodating channel section of an ink supplying apparatus so that a predetermined amount of hot melt ink is supplied to the ink melting section, the ink pellet assembly comprising:

an upper portion having a lateral width greater than a channel width of the accommodating channel section of the ink supplying apparatus;

a pellet main body forming step portions with at least two sides of a lower surface of the upper portion, each of the step portions forming a bearing surface that slidably contacts a surface of the accommodating channel section as the ink pellet moves along the accommodating channel section prior to being deposited into the ink melting section, said pellet main body having a lateral width smaller than the channel width of the accommodating channel section and a height smaller than a channel height of the accommodating channel section; and an ink holder that supports the ink pellet provided to the accommodating channel section by engagement of a supporting section of the holder with the step portions of the pellet main body.

2. The ink pellet assembly according to claim 1, wherein the supporting section of the ink holder comprises a pair of claw members for supporting the ink pellet by engaging with the step portions of the ink pellet, the accommodating channel section having a pair of engagement releasing members corresponding to the pair of claw members for releasing the engagement by pushing open the claw members.

3. The ink pellet assembly according to claim 1, wherein the supporting section of the ink holder includes at least one guide member which contacts with a side surface of the ink pellet to maintain an orientation of the ink pellet upon movement of the ink pellet into the accommodating channel section.

4. The ink pellet assembly according to claim 1, wherein said pellet main body has an unsupported lower portion between the bearing surfaces.

5. The ink pellet assembly according to claim 1, wherein the ink pellet moves substantially horizontally along the accommodating channel section prior to being substantially vertically deposited into the ink melting section.

6. An ink pellet formed of solid hot melt ink and configured for storage in an accommodating channel section of an ink supplying apparatus relative to an ink melting section so that a predetermined amount of hot melt ink is supplied to the ink melting section, the ink pellet comprising:

an upper portion having a lateral width greater than a channel width of the accommodating channel section of the ink supplying apparatus; and a pellet main body forming step portions with at least two sides of a lower surface of the upper portion, each of the step portions forming a bearing surface that slidably contacts a surface of the accommodating channel section as the ink pellet moves along the accommodating channel section prior to being deposited into the ink melting section, said pellet main body having a lateral width smaller than the channel width of the accommodating channel section and a height smaller than a channel height of the accommodating channel section, wherein said pellet main body has an unsupported lower portion between the bearing surfaces.

7. The ink pellet according to claim 6, wherein a center of gravity of the ink pellet exists within the pellet main body.

8. The ink pellet according to claim 6, wherein at least two sides of the pellet main body are inclined such that the lateral width of the pellet main body becomes gradually smaller from an upper surface to a lower surface of the pellet main body.

9. The ink pellet according to claim 6, wherein the ink pellet has corner portions defining a rectangular cross-section and a diagonal distance of the cross-section of the ink pellet at a portion accommodated in the accommodating channel section is greater than a channel width of the accommodating channel section.

10. The ink pellet according to claim 6, wherein the diagonal distance of the cross-section is greater than the channel width of the accommodating channel section by at least approximately 0.5 mm.

11. The ink pellet according to claim 6, wherein the ink pellet moves substantially horizontally along the accommodating channel section prior to being substantially vertically deposited into the ink melting section.

12. An ink holder for supporting at least one ink pellet provided to an accommodating channel section of an ink supplying apparatus, the ink holder comprising:

a supporting section comprising a pair of claw members for supporting the ink pellet by engaging with step portions on at least two sides of the ink pellet; and a pair of guide members which contacts with a side surface of the ink pellet to maintain an orientation of the ink pellet upon movement of the ink pellet into the accommodating channel section, wherein the accommodating channel section includes a pair of engagement releasing members corresponding to the pair of claw members for releasing the engagement by pushing open the claw members.

13. An ink pellet assembly including an ink pellet formed of solid hot melt ink and configured for storage and movement in an accommodating channel section of an ink supplying apparatus so that a predetermined amount of hot melt ink is supplied to the ink melting section, the ink pellet of the ink pellet assembly comprising:

an upper portion having a lateral width greater than a channel width of the accommodating channel section of the ink supplying apparatus; and a pellet main body forming step portions with at least two sides of a lower surface of the upper portion, each of the step portions forming a bearing surface that slidably contacts a surface of the accommodating channel section as the ink pellet moves along the accommodating channel section prior to being deposited into the ink melting section, said pellet main body having a lateral width smaller than the channel width of the accommodating channel section and a height smaller than a channel height of the accommodating channel section, wherein the ink pellet has corner portions defining a rectangular cross-section and a diagonal distance of the cross-section of the ink pelllet at a portion accommodated in the accommodating channel section is greater than a channel width of the accommodating channel section.

14. The ink pellet assembly according to claim 13, wherein a center of gravity of the ink pellet exists within the pellet main body.

15. The ink pellet assembly according to claim 13, wherein at least two sides of the pellet main body are inclined such that the lateral width of the pellet main body becomes gradually smaller from an upper surface to a lower surface of the pellet main body.

16. The ink pellet assembly according to claim 13, wherein the diagonal distance of the cross-section is greater than the channel width of the accommodating channel section by at least approximately 0.5 mm.

17. The ink pellet assembly according to claim 13, wherein a lateral width of the ink pellet is configured such that a side surface of the ink pellet is spaced apart from a side wall surface of the accommodating channel section by at least approximately 1 mm.

18. The ink pellet assembly according to claim 13, wherein the predetermined amount of hot melt ink is an amount sufficient to print one or more pages and an amount which does not significantly deteriorate while in the ink melting section under normal conditions of use.

* * * * *